United States Patent [19]

Fritzsche et al.

[11] 3,936,248

[45] Feb. 3, 1976

[54] CASING FOR ROTARY PISTON ENGINES OF TROCHOIDAL CONSTRUCTION

[75] Inventors: Albert Fritzsche, Markdorf; Karl Jäger, Immenstaad, both of Germany

[73] Assignee: Dornier GmbH, Germany

[22] Filed: Apr. 1, 1974

[21] Appl. No.: 456,883

[30] Foreign Application Priority Data

May 11, 1973 Germany ..... 2323790

[52] U.S. Cl. ..... 418/61 B; 418/150

[51] Int. Cl.[2] ..... F04C 1/02

[58] Field of Search ..... 418/61 B, 150

[56] References Cited

UNITED STATES PATENTS

| | | | |
|---|---|---|---|
| 731,283 | 6/1903 | Cooley | 74/1 |
| 3,226,013 | 12/1965 | Toyoda et al. | 418/122 X |
| 3,726,617 | 4/1973 | Daido | 418/150 |
| 3,764,239 | 10/1973 | Huf | 418/150 X |

*Primary Examiner*—C. J. Husar
*Assistant Examiner*—Leonard Smith
*Attorney, Agent, or Firm*—James E. Bryan

[57] ABSTRACT

This invention relates to an improvement in a casing for a rotary piston engine of trochoidal construction with an outer envelope curve, in which radial sealing strips are mounted in the casing between the individual working chambers, the improvement comprising that the working chamber delimitation between the radial sealing strips constituting the casing is formed by a circular arc approaching the extent of the exact envelope curve, whose center is positioned on the axis of symmetry of the respective working chamber.

1 Claim, 2 Drawing Figures

CASING FOR ROTARY PISTON ENGINES OF TROCHOIDAL CONSTRUCTION

The present invention relates to a casing for rotary piston engines of trochoidal construction with an outer envelope curve, wherein the radial sealing strips are mounted in the casing between the individual working chambers.

Such rotary piston engines include, as an exact working chamber delimitation, an envelope curve to the trochoid equidistant. The working chambers are in each case sealed off with respect to each other by means of radial sealing strips. It also has been proposed to replace the exact envelope curve by a trochoid equidistant, which results, however, in an increase of the undesirable space. For purposes of making such envelope curves, copying devices or specific machining devices must be employed which form or manufacture the respective inner shape in a cutting manner. The aforementioned manufacturing methods, by means of copying devices and the like, involve considerable expenditures with respect to the manufacturing time and initial investment. Particularly in connection with the mass production of casings for the aforementioned rotary piston engines are the factors involving economical considerations and manufacturing techniques of great significance.

It is the object of the present invention to eliminate the disadvantages relating to economic factors and manufacturing techniques in connection with the casings of rotary piston engines, and to provide an inner casing form that can be made with conventional machines, such as, for example, a boring mill, honing and grinding devices, and the like.

This object is obtained, in accordance with the present invention, by virtue of the fact that the working chamber delimitation between the radial sealing strips constituting the casing is formed by a circular arc approaching the course of the exact envelope curves, whose center is positioned on the axis of symmetry of the respective working chamber. By virtue of this indicated or proposed provision of the working chamber within the casing, the latter is advantageously manufacturable by the use of conventional machining devices, such as a boring mill, turning machines, and the like. This also produces the possibility of effecting without difficulty the most diversified dimensions within the meaning of a class or series of fabricated products. The increase or enlargement of the working chamber on the basis of the circular arc being approximated to the envelope curve of the inner casing form or shape is found to be insignificant since the structurally caused, undesirable spaces, such as plays, valve connections, and the like, quite generally amount to a higher percentage in comparison. The compression ratio is thus, due to the formation of the working chambers with circular arcs, impaired only to a negligible extent so that the economic advantages and the advantages relative to manufacturing techniques by far outweight any disadvantages in the normal case of application.

Figure 1:
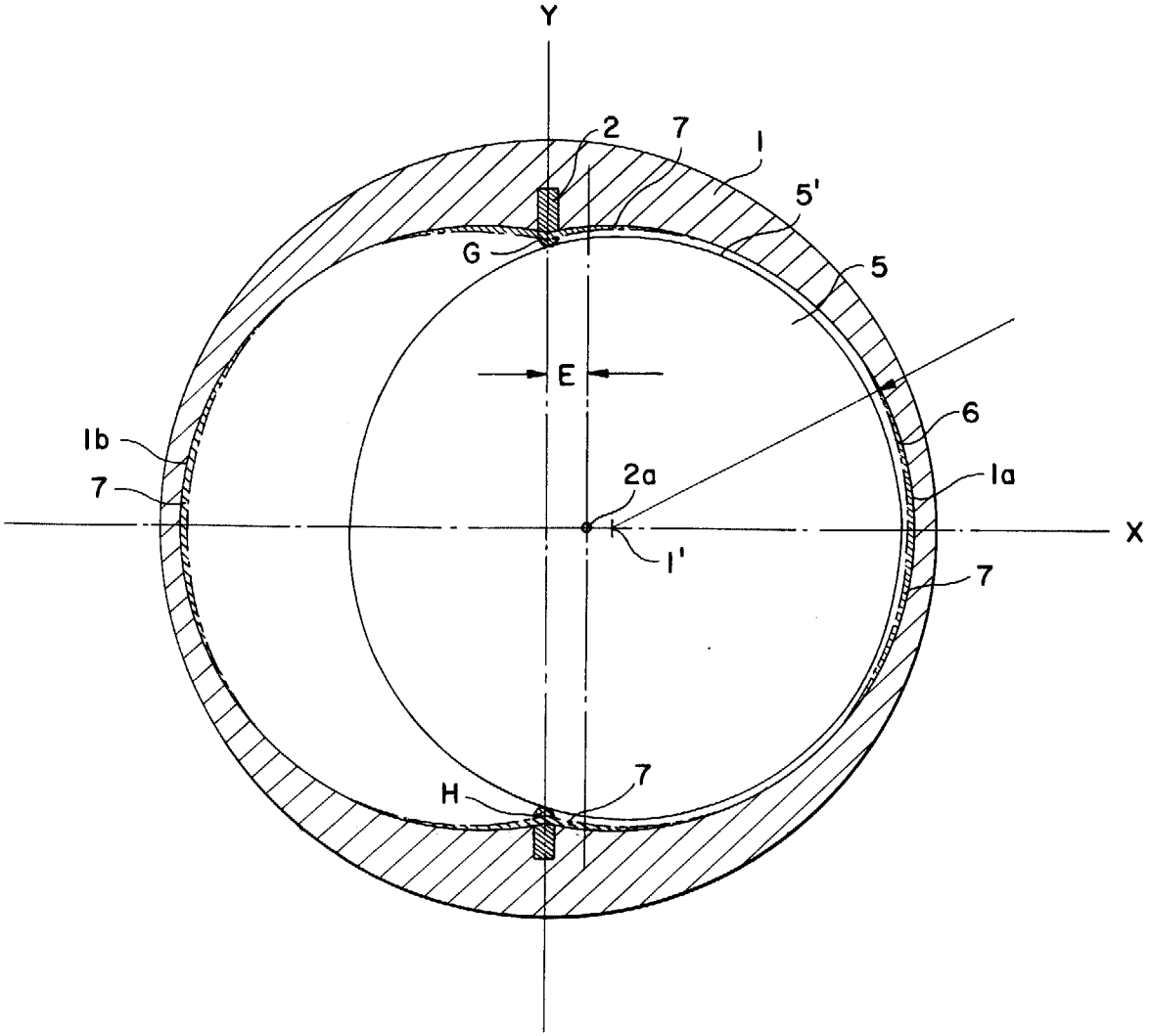
Figure 2:
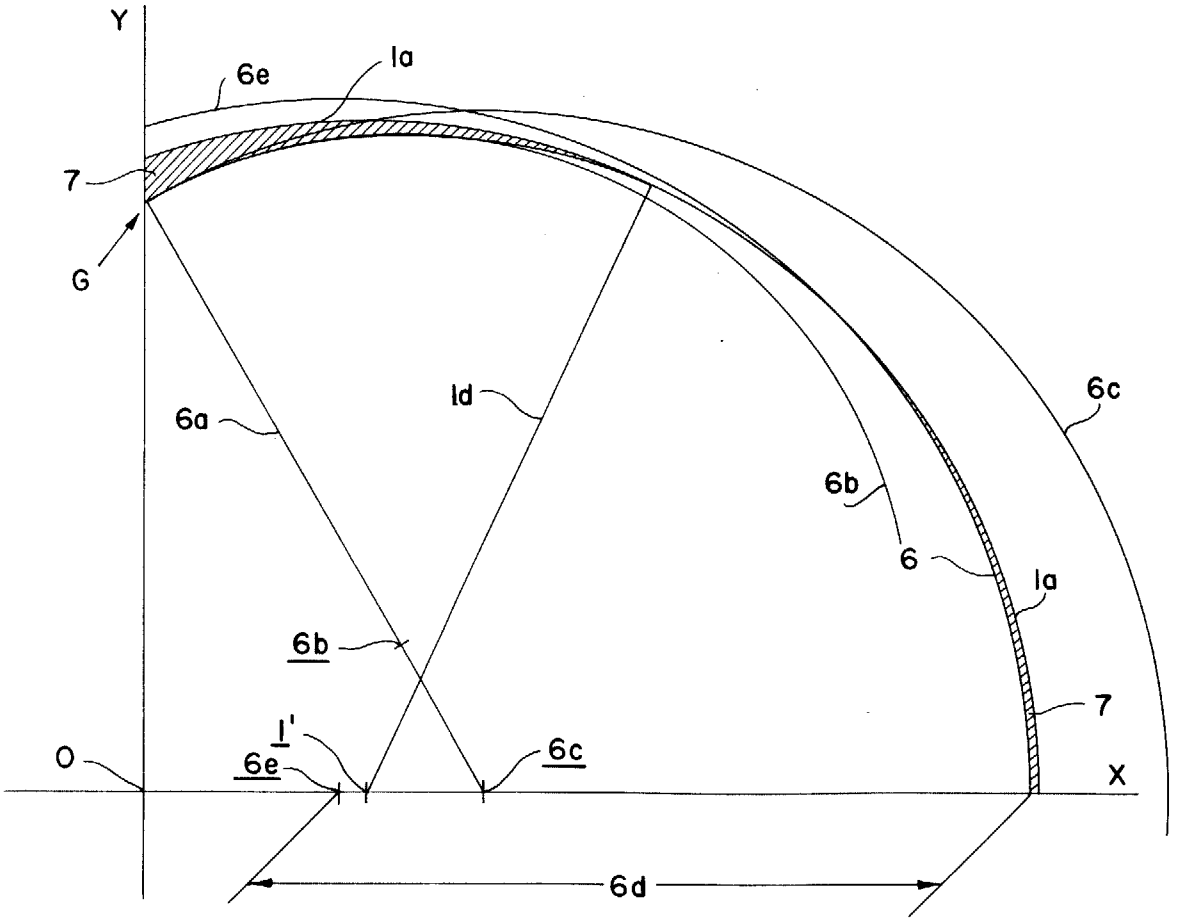

One embodiment relative to a casing as proposed by the present invention will now be further explained hereinafter in connection with and with reference to the accompanying drawings, wherein FIG. 1 is a cross-sectional view through the inner casing form or shape in a two-chamber arrangement, and FIG. 2 illustrates the geometrical conditions between the exact envelope curve to the trochoid equidistant and the circular arc construction.

Illustrated in detail in FIG. 1 is a casing 1 in which a piston 5 is positioned in the dead center position. The casing has the radial sealing strips 2 which are positioned in the Y-axis and slide on the piston surface 5'. The points G and H are the trochoid-producing points. By means of the sealing strips 2, the working chambers are mutually sealed off in the radial direction. The exact cross-sectional provision of the working chamber is illustrated in a dash-dotted line. This cross-sectional provision of the working chamber represents an envelope curve to the trochoid equidistant of the piston. The cross-sectional construction of the working chamber according to the present invention is represented by the identical circular arcs 1*a* and 1*b*. These circular arcs 1*a* and 1*b* are so provided and arranged that they are tangent, in each case twice per working chamber, at the exact envelope curve 6 and, in each case, reach up to the radial sealing strips 2. The deviation of the circular arcs 1*a* and 1*b* from the exact envelope curve 6 is illustrated in FIG. 1 by shaded sickle-shaped areas 7. This deviation of the circular arcs 1*a* and 1*b* from the exact envelope curve 6 amounts, at optimum design, to a percentage in the range of the structurally-conditioned undesirable spaces so that an insignificant impairment of the compression ratio will result. The piston turning axis 2*a* is positioned at the distance E from the center of the envelope curve. Illustrated in FIG. 1 is the center point 1' for the circular arc 1*a* and accordingly symmetrically results on the X-axis for the circular arc 1*b*.

Illustrated in FIG. 2 is the X- and Y-axis for one working chamber, as well as the envelope curve 6. The center of the circular arc approximating the exact envelope curve is determined in the following manner:

The radius of curvature of the envelope curve at the point of intersection thereof with the Y-axis is extended beyond its center 6*b* up to the point of intersection 6*c* with the X-axis. The center of the radius of curvature 6*d* of the envelope curve at the point of intersection thereof with the X-axis is 6*e*. The center 1' of the circular arc 1*a*, having the radius 1*d*, enclosing the envelope curve 6 is positioned between the points. The most favorable position of the circular arc center 1*a* can be found empirically. The mathematically precise determination of the center point 1' is possible, but is not the subject matter of the present invention. The deviation of the circular arc 1*a* from the exact envelope curve 6 is illustrated in FIG. 2 by shaded sickle-shaped areas 7.

The manufacture of the working chambers with circular arched cross-sectional shape may be effected without difficulties with conventional machining devices. By virtue of the aforementioned method of manufacture, an economically advantageous and simple solution, from the point of view of manufacturing techniques, is thus possible for making the working chambers of rotary piston engines of trochoidal construction with an outer envelope curve. The structure or provision of the working chambers within casings by the circular arcs 1*a* and 1*b* applies in the same manner for all rotary piston engines of trochoidal construction with radial sealing strips 2 mounted on the side of the housing, wherein the inner casing form or shape is centrosymmetrically composed of envelope curves 6.

It will be obvious to those skilled in the art that many modifications may be made within the scope of the present invention without departing from the spirit thereof, and the invention includes all such modifications.

What is claimed is:

1. In a casing for a rotary piston engine of trochoidal construction having a piston in the shape of an epitrochoid, a casing corresponding to an outer envelope curve, and individual working chambers with radial sealing strips mounted between them, the improvement comprising that the working chamber delimitation between the radial sealing strips constituting the casing is formed by a circular arc approaching the extent of the envelope curve, whose center is positioned on the axis of symmetry of the respective working chamber, said center of said circular arc being positioned between the point of intersection which results from the respective normal to the envelope curve at the end point of said envelope curve arc associated with the pertinent working chamber and the axis of symmetry of the corresponding working chamber, and the center of the envelope curve radius of curvature on the axis of symmetry of the corresponding working chamber.

* * * * *